United States Patent [19]

Marcu

[11] Patent Number: 4,940,368

[45] Date of Patent: Jul. 10, 1990

[54] PROPULSION SYSTEM AND PROCESS FOR PNEUMATIC PIPELINE TRANSPORT

[76] Inventor: Mihail I. Marcu, 118 Locke St. N., Hamilton, Ontario, L8R 3A8, Canada

[21] Appl. No.: 187,468

[22] Filed: Apr. 28, 1988

[51] Int. Cl.[5] ..... B61D 13/10

[52] U.S. Cl. ..... 406/79; 406/93; 104/138.1

[58] Field of Search ..... 104/138.1, 88; 105/365; 406/1, 15, 19, 105, 93, 79

[56] References Cited

U.S. PATENT DOCUMENTS

| | | | |
|---|---|---|---|
| 3,861,319 | 1/1975 | Gelhard et al. | 104/138.1 |
| 3,881,425 | 5/1975 | Carstens | 104/138.1 |
| 3,980,024 | 9/1976 | Futer | 104/138.1 |
| 3,999,487 | 12/1976 | Valverde | 406/105 |
| 4,165,696 | 8/1979 | Chukhanov et al. | 104/138.1 |
| 4,240,768 | 12/1980 | Carstens | 406/105 |
| 4,458,602 | 7/1984 | Vandersteel | 104/138.1 |

FOREIGN PATENT DOCUMENTS

| | | | |
|---|---|---|---|
| 71077 | 6/1977 | Japan | 406/105 |

*Primary Examiner*—Sherman D. Basinger
*Assistant Examiner*—Stephen P. Avila

[57] ABSTRACT

Pressure propulsion system and process for pneumatic pipeline transport using containers which, in aim to eliminate flap-valves or the like, is using only an open ended at both ends continuous tubular structure/pipeline inside of which the wheeled containers are pressed-/introduced bumper to bumper by a chain or other pushing mechanism and also air is injected via only one orifice or manifold into the said continuous pipeline at a certain distance downstream from the said chain or pushing mechanism making possible the pneumatic propulsion of the said containers by the compressed air along the continuous tubular structure/pipeline.

1 Claim, 1 Drawing Sheet

PROPULSION SYSTEM AND PROCESS FOR PNEUMATIC PIPELINE TRANSPORT

BACKGROUND OF THE INVENTION

1. Field of the Invention

This invention relates to large diameter tubular pneumatic transport using wheeled containers sometime known as pneumatic wheeled container transport or even tube vehicle systems. More particularly this invention relates to a propulsion system using air pressure having only one pipeline opened at both ends and only one propulsion unit placed at one end of this pipeline, this end being associated with the introduction of the wheeled containers inside of the said pipeline.

2. Prior Art

The large diameter pneumatic tubular transport using wheeled containers is a very old art and was proposed and implemented first by Latimer Clark in U.K. in 1865 (40" cross section, steel wheels, cargo transport—Battersea near London). Immediately after this, Alfred E. Beach built a large demonstrator prototype for passengers in U.S.

Lack of mass produced tubes, cheap electric energy and efficient air moving machinery in conjunction with the competition from the part of railway technology made the large diameter tubular transport to lay dormant till 1960–1964.

The modern large diameter wheeled pneumatics is started in Germany in 1960 (Kirchheim et All) for diameters ranging from 450 mm to 700 mm. The Kirchheim group developed and patented before 1970 almost all variants of containers, propulsion and auxiliary equipment (e.g. chains) used today in U.K. U.S.S.R., U.S., Japan (in Romania they use steel wheels).

The large tubular transport using wheeled containers was implemented industrially first time in the world in U.S.S.R. (1971) by Alexandrov, followed by Romania (H. Coanda & C. Teodorescu) and Japan (Nakamura). There are over 60 industrial installations built to date, the largest being of 50 km (U.S.S.R.).

Serious efforts are made in U.S.A., Canada, South Africa to implement this technology for bulk material handling.

The known usually used systems for propulsion of containers in pneumatic pipeline systems are using valves like flap valves, check valves, or gate valves involving or not servomechanisms to assure the necessary pressure for propulsion and letting the containers to pass the propulsion area.

The main disadvantage of these valves is the fact that the containers often smash them because they are not fast enough to let the containers to pass the propulsion area, and also the valve commutation is associated with large transients or even pushing the containers in reverse direction. Also, another big disadvantage of these valves is the fact that those which are servoactuated have a complicated structure implying hydro, electric or pneumatic subsystems not reliable in long term in heavy duty operation specially in remote unsupervised areas or involving low qualified personnel.

Another class of propulsion systems described in patent literature (U.S. Pat. No. 3,881,425) is using a pipeline and a series of boosters pumps (at least 2), that is propulsion units spaced along the pipeline and a series of booster relays. This succession of booster is aimed to operate a very long pipeline (say 500 miles). In this booster relays configuration the air is extracted from the upstream by a manifold, then reinjected downstream by another manifold, the containers being actually sucked by air from upstream and air pushed downstream. Between the said manifolds, there is a bypass area where the container is slowed down as stopped before being ejected downstream. In this bypass area, the containers tend to be reversed and this tendency is counteracted by an externally powered mechanism like a conveyor belt with a gently sloping upper flight which allows the containers to straddle, then to be ejected further downstream in the pipeline. In this case, the container is all the time in the pipeline being ejected from time to time from the bypass area.

In this multibooster configuration the boosters are placed somewhere on the pipeline eventually at the middle of it.

This system with bypass and multiboosters (U.S. Pat. No. 3,881,425) is better than others but still complicated because: has a pump area (in fact many of them), where containers have to stop, has two manifolds system to take air from upstream and inject it downstream, has at least two pump means located at spaced points along the pipeline. Also, it is unreliable because of the conveyor flight device which is not strong enough for the large forces developed by the pneumatic propulsion process. So this system actually involves different objects and structures along the pipeline obstructing the flow of containers which have to stop hence to lose kinetic energy in the propulsion process.

It is an object of this invention to provide a propulsion system which eliminates the need of many relay-boosters system of propulsion, flap valves or the like, reducing the propulsion unit to only one.

It is a further object of this invention to provide a propulsion system for continuous movement/flow of containers which is not wasting the kinetic energy of the containers simply by not stopping them when they pass the propulsion area.

It is yet a further object of this invention to provide a propulsion unit which reduces the number of manifolds reducing them to only one.

It is a still further object of this invention to provide a propulsion unit with a reliable strong system of moving containers in the propulsion area so that it to be able to face the usually huge counter forces experienced by the pneumatic propulsion process.

It is a still further object of this invention to use only pressure principle propulsion process.

It is a still further object of this invention to use pressure principle propulsion instead of suction and pressure.

It is a still further object of this invention to use only one continuous pipeline unobstructed along it by associated objects/structures or mechanisms.

The main object of this invention is to provide a propulsion unit which is simple in construction and relatively maintenance free.

SUMMARY OF THE INVENTION

The foregoing and other objects are achieved by this invention/system which is comprising: a main continuous unobstructed pipeline open ended at both ends so that there are not any objects, mechanisms, manifolds or other structures along it, one open end of the said continuous pipeline called hereinafter the entrance open end and the other open end of the same pipeline hereinafter being called the exit open end; also, the system is comprising an unidirectional forced container introduction device like a roller chain or rollers and dogs chain or an electromagnetic force generator like a linear induction motor or a hydraulic or pneumatic ram system aimed to push the wheeled containers unidirectionally inside of the said pipeline, this forced induction device being placed outside of the said continuous pipeline at the entrance open end area precluding the back movement / reversing of the containers; also, the system is comprising an air pneumatic propulsion unit like a fan, blower or compressor placed at a certain distance downstream the entrance open end of the pipeline, this pneumatic air compressing propulsion unit taken air directly from the atmosphere and injecting this compressed air into the pipeline via an injection manifold downstream at a certain distance from the said entrance open end of the pipeline.

The process of operating of the above system is as follows: The containers are coming at low speed but at a relatively constant frequency from upstream the forced induction device, reach the forced induction device, subsequently being forced/pushed by this forced introduction device into the entrance open end of the pipeline, continue to be pushed, then immediately their back passes over the air injection manifold continue to be pushed downstream along the pipeline by the compressed air supplied via the said injection manifold by the air compressing pneumatic propulsion unit, therefore continuing their travel toward the other open end/exit of the pipeline.

This approach is essentially eliminating any obstructions along the pipeline letting it free for pneumatic propulsion. The frequency/flow rate of the containers is kept constant by the forced introduction device.

BRIEF DESCRIPTION OF THE DRAWING

These and other objects, features and advantages of the invention will be better understood by reading the following detailed description in conjunction with the attached drawing, in which.

DETAILED DESCRIPTION OF THE DRAWING

Figure 1:
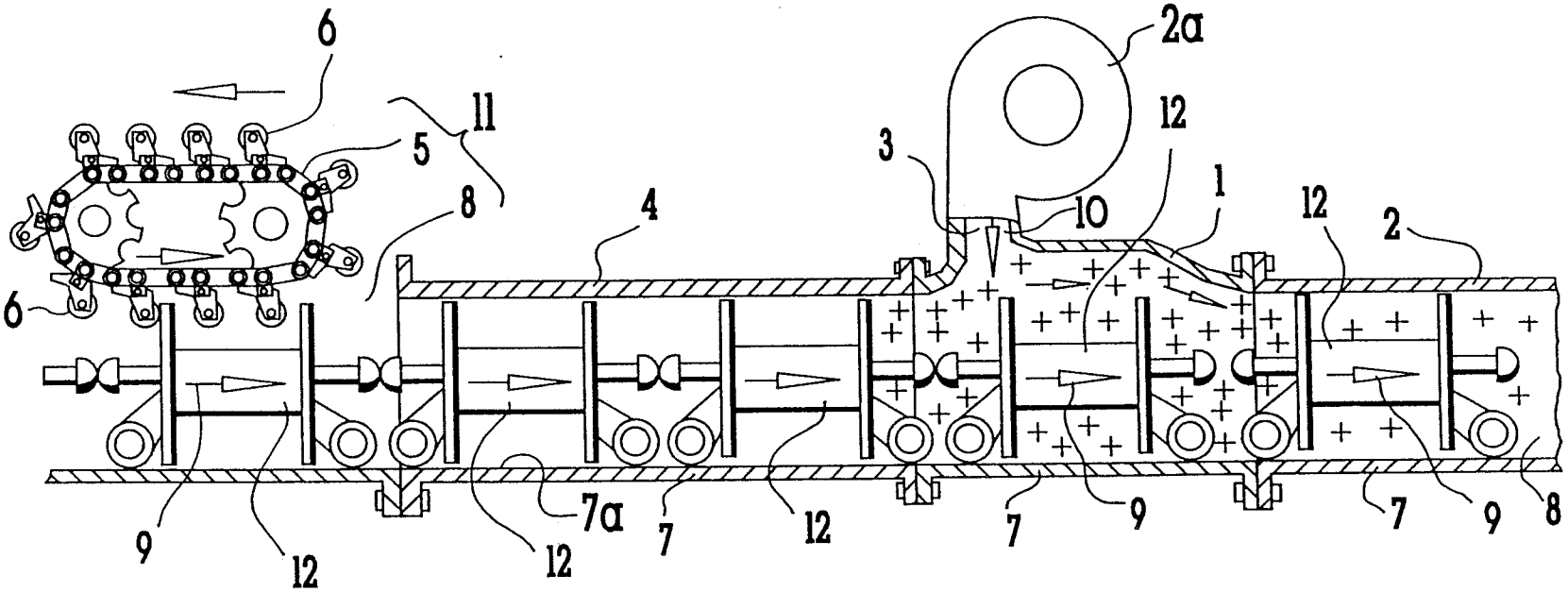
FIG. 1 is a graphic representation of a propulsion system for pneumatic pipeline transport constructed in accordance with the principle of the invention, showing a longitudinal section in the pressure propulsion system with forced introduced containers.

FIG. 1 is a graphic representation of a propulsion system according to the invention. The system basically comprises: a larger tubular segment 1, a continuous open ended pipeline, the larger tubular segment 1 being connected to the continuous open ended pipeline 2, the said larger tubular segment 1 having a bigger cross section than the main pipeline 2, also the system has a blower 2a or some other subsystem to generate air pressure and flow pumping compressed air through an orifice/injection manifold 3 into the said large tubular segment 1, the orifice/injection manifold 3 being in the wall of the said larger tubular segment, also the system comprises a tighter tubular segment 4 placed upstream and in continuation of the larger tubular segment 1, this tighter tubular segment 1 being of smaller cross section area than the open ended continuous pipeline 2 and being or not padded with a teflon like material such as ultrahigh molecular weight polyethylene, polyurethane or polytetraflourethilene, the said tighter segment 4 having a length bigger than that of a container; also, the system comprises a forced introduction device 5 placed upstream of the tighter tubular segment, in this case a heavy duty chain with pushing articulated elements/-dogs 6; also, the system is in fact a continuous tubular structure 7 open ended at both ends 8 having the bottom part 7a continuous for letting the containers to roll in the direction of the flow 9. As it is seen, the system has a blower or the like 2 placed immediately after the area where the containers are introduced, simply pushing, injecting air 10 into the said continuous open ended tubular structure or pipeline 7 having one open end free 8 and at the other end 11 being the said forced introduction device 5 for pushing containers inside of the continuous pipeline.

The process of propulsion for the proposed system is as follows: the containers 12 are coming from upstream bumper to bumper approaching the forced introduction device 5, then the introduction device by its elements/-dogs 6 is pushing the containers 12 like some plugs or pistons into the tighter tubular segment 4, the said containers 12 being pushed by the force of the said forced introduction device 5, so that they are moving bumper to bumper and reach the downstream area of the larger tubular segment, where the air 10 is injected through an injection manifold/orifice 3 in the wall of this larger tubular segment, so that the said air 10 being restricted to go out in the area of the upstream tighter tubular segment 4, will push the containers downstream in the direction of the flow 9 in the continuous open ended pipeline 7 because of the over pressure generated in the larger tubular segment 1, so that the containers 12 are simply entering upstream in the open ended continuous pipeline by the help of the said forced introducing device 5 and they are getting out somewhere downstream at the other open end of the said continuous open end pipeline actually a tubular succession comprising the tighter tubular segment 4, larger tubular segment 1 and the open ended continuous pipeline.

What is claimed is:

1. A propulsion system for pneumatic pipeline transport of wheeled containers comprising:

(a) a continuous tubular main pipeline section with an input end and an open output end;

(b) a secondary tubular pipeline section of smaller diameter than the main pipeline section with an open inlet end and an output end;

(c) a single generally tubular air injection manifold pipeline section of larger diameter than the main and secondary pipeline sections with an input end and an output end;

(d) a single device to inject high pressure air into the main pipeline via the manifold section;

(e) wherein the output end of the secondary pipeline is connected to the input end of the manifold section and the output end of the manifold section is connected to the input end of the main pipeline section to form a continuous pneumatic pipeline;

(f) wheeled containers;

(g) a single forced introduction device in the form of a mechanical conveyor being located outside the pipeline to introduce the containers into the input end of the secondary pipeline section; and (h) wherein the propulsion of the wheeled containers in the main pipeline section is solely provided by the single injection device.

* * * * *